US005912943A

United States Patent [19]

Deucher et al.

[11] Patent Number: 5,912,943

[45] Date of Patent: Jun. 15, 1999

[54] COOLING SYSTEM FOR A SEALED HOUSING POSITIONED IN A STERILE ENVIRONMENT

[75] Inventors: Joseph S. Deucher, Lyndhurst; Marc Piscitelli, Richmond Heights; Dennis K. Everett, Seven Hills, all of Ohio

[73] Assignee: Picker International, Inc., Highland Heights, Ohio

[21] Appl. No.: 08/979,286

[22] Filed: Nov. 26, 1997

[51] Int. Cl.[6] ..... H05G 1/64

[52] U.S. Cl. ..... 378/98.8; 378/167

[58] Field of Search ..... 378/98.8, 167, 378/182, 189, 199, 200; 258/363.05, 363.08

[56] References Cited

U.S. PATENT DOCUMENTS

| | | | |
|---|---|---|---|
| 4,866,743 | 9/1989 | Kroener | 378/4 |
| 4,969,167 | 11/1990 | Zupancic et al. | 378/19 |
| 5,235,191 | 8/1993 | Miller | 250/486.1 |
| 5,693,948 | 12/1997 | Sayed et al. | 250/370.09 |

OTHER PUBLICATIONS

"Percutaneous Vertebroplasty Guided By a Combination of CT and Fluoroscopy", Afshin Gangi, et al., *AJNR* 15:83–86, Jan. 1994.

"The Interventional CT and Fluoroscopy Room" Z.L. Barbaric, MD, et al. *Abstract, Radiology,* Nov., 1996, vol. 201P p. 475.

Swissary Advertisement, *Medical Imaging,* vol. 12, No. 9, Sep., 1997.

Picker International, Orbitor HF Mobile C–Arms Product Data Sheet, 1994.

FischerImaging Product Data Sheet—Ceiling Suspended Imaging System.

*Primary Examiner*—David P. Porta

*Attorney, Agent, or Firm*—Fay, Sharpe, Beall, Fagan, Minnich & McKee, LLP

[57] ABSTRACT

An imaging device includes a support member (30), a x-ray source (32) mounted to the support member via a first arm (34), and an x-ray detector (36) mounted to the support member via a second arm (38). The x-ray detector includes a sealed housing (72) mounted to the second arm and a flat panel image receptor (74) retained within the housing. A cooling system (G) exchanges heated air in the housing with ambient air located remote from the housing. The support member (30) includes an open channel (68), a closed channel (70), a common wall (106) separating the open channel from the closed channel, and a series of vents (108) through the common wall. The second arm (38) includes an inlet passage (92) and an exhaust passage (90) each of which communicate with the closed passage (70) and interior cavity (98) of the housing. At least one fan (100) is positioned in at least one of the exhaust passage and the inlet passage. An air deflector (102) extends over the inlet passage and the outlet passage at the first end thereof to prevent exhaust air from being drawn into the inlet passage. A baffle (96) extends through the cavity (98) to direct the flow of air within the cavity.

24 Claims, 9 Drawing Sheets

COOLING SYSTEM FOR A SEALED HOUSING POSITIONED IN A STERILE ENVIRONMENT

BACKGROUND OF THE INVENTION

The present invention relates to the medical diagnostic imaging arts. It finds particular application in conjunction with a fluoroscopy subsystem associated with a diagnostic imaging device, and will be described with particular reference thereto. However, it should be appreciated that the present invention may also find application in conjunction with dedicated fluoroscopy devices and other diagnostic imaging systems which provide cooling for an imaging component that is positioned in a sterile work environment.

Heretofore, fluoroscopy devices have been used to provide fluoro images during interventional procedures. Present fluoroscopy devices are big and bulky, and because of their size, they are difficult to store, and are typically in the way when not in use. That is, known fluoroscopy devices typically use large, cylindrical image intensifier tubes which are difficult to maneuver and position. Further, the interventionalist must stand beside the image intensifier tube to access the patient during an interventional procedure. Reaching around the large intensifier tube can be awkward for the interventionalist. Further, image intensifier tubes tend to introduce distortion in the resulting diagnostic images due to glass curvature and magnetic effects.

Using an amorphous silicon flat panel image receptor in place of a conventional image intensifier tube overcomes some of the disadvantages noted above. However, the electronics associated with the flat panel image receptor generate heat within a housing thereof which must be purged in order to insure the proper operation of the flat panel image receptor.

When performing minimally invasive or interventional procedures such as tumor biopsies, abscess drainages, bone intervention, visceral, head and neck trauma, and catheter placement for organ assessment, instruments such as catheters are typically placed or positioned in a patient using the fluoroscopic device prior to performing the minimally invasive procedure. When the fluoroscopic system is in use, the flat panel detector housing is positioned immediately adjacent the site where the minimally invasive procedure is to be performed.

Maintaining a sterile environment surrounding the site of the minimally invasive procedure is a major concern. Equipment, such as the flat panel image receptor housing of a fluoroscopy system, cannot be easily sterilized. Thus, the detector housing is typically sealed within a sterile bag. However, heated air within the flat panel detector housing cannot be exchanged with ambient air surrounding housing because of the sealed nature of the housing. Further, even if heated air in the housing was exchanged with ambient air surrounding the housing, there is a further risk of contaminating the minimally invasive procedure site with airborne contaminates that are circulated as a result of the air exchange.

Further, the air currents and sounds generated as a result of exchanging heated air inside the housing with ambient air surrounding the housing can be a nuisance which distracts the patient, interventionalist and/or other medical personnel working at the site of the minimally invasive procedure.

Accordingly, it has been considered desirable to develop a new and improved cooling system for an image detector housing of a fluoroscopic system which meets the above-stated needs and overcomes the foregoing difficulties and others while providing better and more advantageous results.

SUMMARY OF THE INVENTION

In accordance with one aspect of the present invention, an imaging device is provided. The imaging device includes a support member, an x-ray source mounted to the support member, and an x-ray detector mounted to the support member. The x-ray detector includes a sealed housing defining a cavity. A flat panel image receptor retained within the cavity. The imaging device also includes a cooling system for exchanging heated air in the housing with ambient air located remote from the housing.

In accordance with another aspect of the present invention, an imaging device is provided. The imaging device includes a frame having a bore therethrough defining an examination region, an image reconstruction processor for reconstructing volumetric image representations of an object positioned within the examination region, and a fluoroscopy device for generating and displaying substantially real-time fluoroscopic projection image representations of the object. The fluoroscopy device includes a support member, an x-ray source mounted to the support member, and an x-ray detector mounted to the support member. The x-ray detector includes a sealed housing mounted defining a cavity. A flat panel image receptor is retained within the cavity. The fluoroscopy device also includes a cooling system for exchanging heated air in the housing with ambient air located remote from the housing.

In accordance with yet another aspect of the present invention, a method of generating fluoroscopic image representations of an object using a fluoroscopy device is disclosed. The fluoroscopy device includes a support member, an x-ray source mounted to the support member, and an x-ray detector mounted to the support member. The x-ray detector includes a sealed housing defining a cavity, and a flat panel image receptor retained within the cavity. The method includes activating the x-ray source and x-ray detector, and exchanging heated air in the sealed housing with ambient air at a location remote from the housing.

One advantage of the present invention is the provision of a diagnostic imaging device which can be sealed within a bag to maintain the sterility of the device.

Another advantage of the present invention is the provision of a fluoroscopy device having a cooling system which permits the remote exchange of ambient air with heated air from a sealed flat panel image receptor housing to maintain a sterile work environment proximate the housing.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
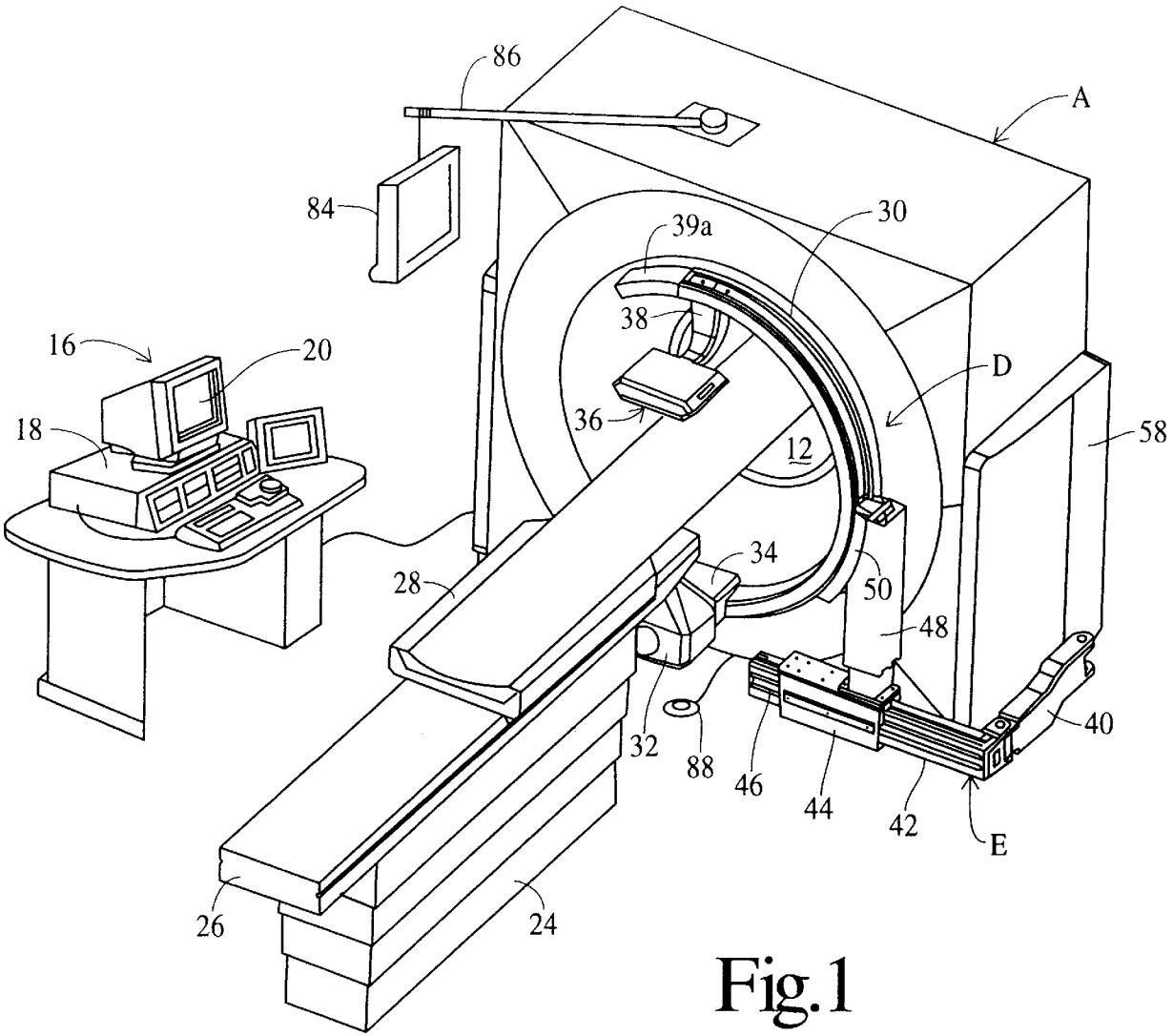
FIG. 1 is a perspective view of a CT scanner having an integrated fluoro-assist device with a C-arm shown in an operating position.
Figure 2:
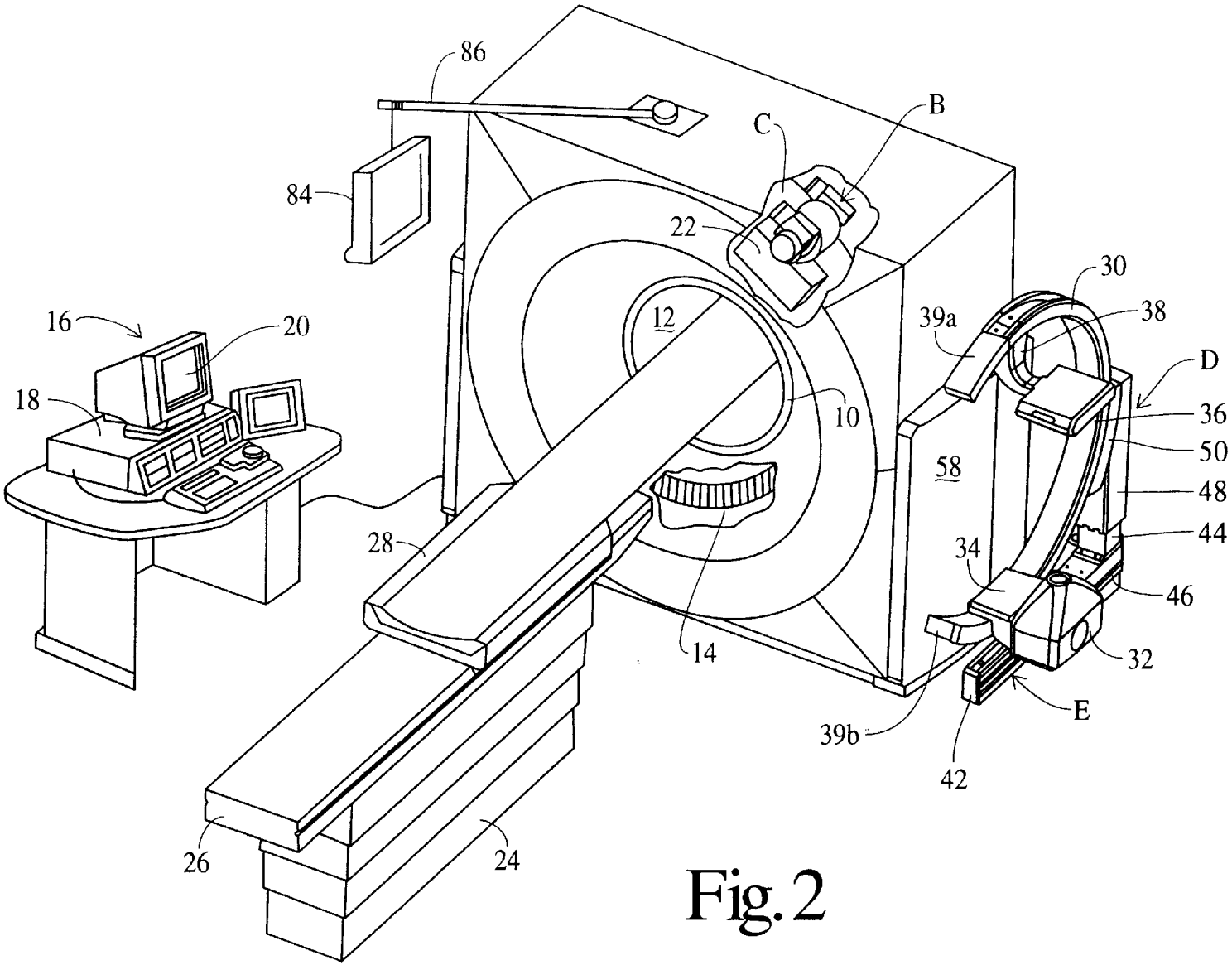
FIG. 2 is a perspective view of the CT scanner of FIG. 1 with the C-arm shown in a stored position adjacent the CT gantry.

With reference to FIGS. 1 and 2, an exemplary diagnostic imaging system, such as a CT scanner, includes a floor-mounted, non-rotating frame member or gantry A whose position remains fixed during data collection. An x-ray tube B is rotatably mounted on a rotating frame member or gantry C. The stationary gantry A includes a cylinder 10 that defines a patient examination region 12. An array of radiation detectors 14 are disposed concentrically around the patient receiving region. In the illustrated embodiment, the x-ray detectors are mounted on the stationary gantry portion such that an arc segment of the detectors receives radiation from the x-ray tube B which has traversed the examination region 12. Alternatively, an arc segment of radiation detectors can be mounted to the rotating gantry to rotate with the x-ray tube. The x-ray tube B and radiation detectors 14 comprise a diagnostic imaging subsystem of the diagnostic scanner.

A control console 16 contains an image reconstruction processor 18 for reconstructing an image representation out of signals from the detector array 14. Preferably, the image reconstruction processor reconstructs a volumetric image representation from radiation attenuation data taken along a spiral path through the patient. A video monitor 20 converts selectable portions of the reconstructed volumetric image representation into a two-dimensional human-readable display. The console 16 includes tape and disk recording devices for archiving image representations, and also includes circuitry for performing image enhancements, selecting planes, 3D renderings, or color enhancements, and the like. Various scanner control functions such as initiating a scan, selecting among different types of scans, calibrating the system, and the like, are also performed at the control console 16.

The x-ray tube B includes an oil filled housing that has an x-ray permeable window directed toward the patient receiving region. An evacuated envelope is disposed within the housing and contains a rotating anode, such as a 7-inch anode, and a cathode or other electron source. High voltages, on the order of 150 kV applied between the rotating anode and the cathode, cause the generation of x-rays. The x-rays pass through the x-ray permeable window and across the patient receiving region 12.

Appropriate x-ray collimators 22 focus the radiation into one or more planar beams which span the examination region 12, as is conventional in the art. The console 16 includes circuitry for gating the x-ray source B to control patient dosage. A high voltage power supply is mounted on the rotating gantry for rotation with the x-ray tube.

A fixed patient table 24 is positioned adjacent the diagnostic scanner so as to extend from the examination region 12 in a first direction substantially along a central axis of the cylinder 10. A patient beam 26 is secured to an upper surface of the patient table 24. A patient couch 28 is slidably secured to the patient beam 26 for back and forth movement through the examination region 12 along the beam 26. It should be appreciated that at least the patient couch can be configured to pan laterally relative to a longitudinal axis of the gantry bore. The table 24, beam 26, and couch 28, cooperate to define a patient support which is adapted for movement through the examination region.

An integrated fluoroscopy or fluoro-assist device D is secured to the gantry A for movement between an operating position (FIG. 1) and a stored position (FIG. 2). The fluoro-assist device includes a support member that is movably secured to either side of the gantry A via a mounting structure E. In the embodiment being described, the support member is a C-arm 30.

A fluoroscopic x-ray source or tube 32 is secured proximate a first end of the C-arm 30 via a cantilevered support bracket 34. Likewise, an opposing x-ray or image detector 36 is secured proximate a second end of the C-arm 30 via a cantilevered support bracket 38. An upper counterweight 39*a* extends from the first end of the C-arm and a lower counterweight 39*b* extends from the second end of the C-arm. The x-ray source 32 and detector 36 cooperate to define a fluorographic imaging subsystem of the diagnostic scanner.

In the embodiment being described, the mounting structure E includes a first link or support arm 40 having one end pivotally secured to the gantry A and the other end pivotally secured to a second link or support arm 42. A first upright support arm 44 is movably secured to the second arm 42 for substantial horizontal movement along a track 46 associated with the second arm 42. A second upright support arm 48 is movably secured to the first upright support arm 44 for substantial vertical movement along a common longitudinal axis of the upright support arms 44, 48. The C-arm 30 is rotatably supported by a bearing assembly 50 associated with the second upright support arm 48 which permits the x-ray source 32 and detector 36 to rotate about a geometric center of the C-arm through an arc of at least 180°.

The mounting structure E permits the C-arm to be conveniently stored or parked along the side of the gantry when not in use, and, when needed, to be positioned in front of the gantry with the x-ray source 32 placed directly under the patient table. In particular, the first support arm 40 pivots approximately 180° around the gantry when moving the C-arm between the stored position and the operating position. Further, the second support arm 42 pivots approximately 90° around the first support arm 40 when moving the C-arm between the stored position and the operating position. However, it should be appreciated that the C-arm can be mounted to any other part of the gantry.

The bearing assembly 50 permits the C-arm 30, and thus the x-ray source 32 and detector 36, to be rotated around a longitudinal axis of the patient from the "under table" position shown in FIG. 1, to a lateral position on either side of the patient table. This provides a ±90°, or any angle in-between, movement of the x-ray source 32 and detector 36 from the "under table" position to provide lateral imaging from both sides of the patient.

The C-arm 30 moves vertically as the second upright support arm 48 telescopically extends and retracts vis-a-vis the first upright support arm 44 to permit easier access to the patient and to adjust image magnification. The C-arm also moves laterally across the patient with the first and second upright support arms 44, 48 vis-a-vis the track 46 to allow lateral image panning across a patient's body. Longitudinal image panning (i.e. along a patient's body) is accomplished by automatically or manually driving the patient couch 28 in either or both directions along the rail 26. It should be appreciated that the bearing assembly 50 could permit the plane of the C-arm to rotate or tilt from an orientation normal to an axis of the patient support (e.g. to a position with the x-ray source 32 over the patient table and the detector 36 under the patient table). Thus, an operating position of the flat panel image receptor is broadly defined herein as any position or orientation (i.e. above, below, adjacent, etc.) of the detector 36 relative to the patient support without regard to the position of the detector relative to the gantry bore (i.e., within the bore or proximate the bore). The stored position of the detector 36 is defined as a position which is remote from at least one of the patient support and the gantry bore.

Figure 3:
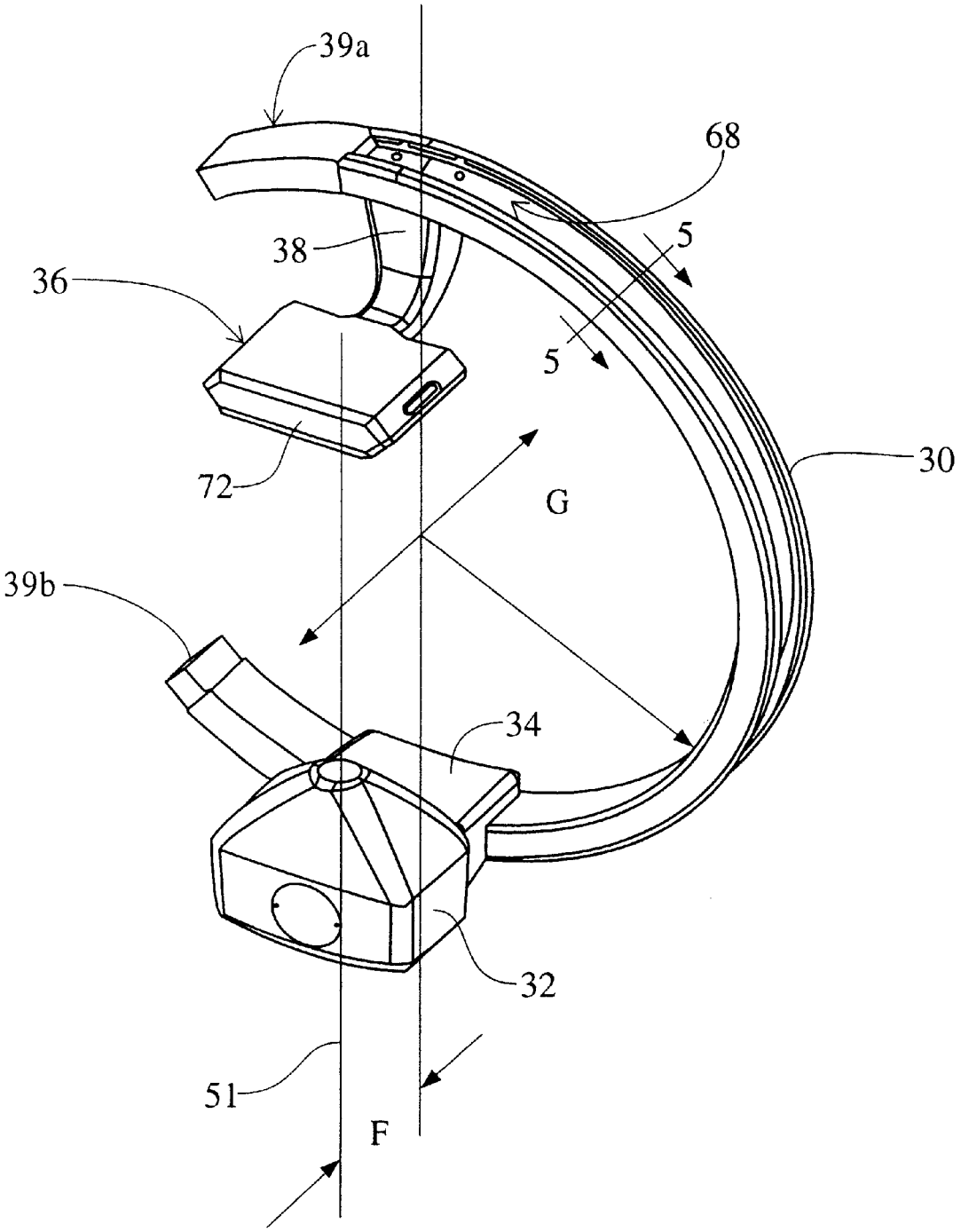
FIG. 3 is a perspective view of the C-arm of FIGS. 1 and 2.

Referring now to FIG. 3, the x-ray source 32 and the detector 36, and more particularly a centerline 51 of the imaging system, is offset a distance F from a plane of the C-arm by the cantilevered support brackets 34, 38. An fluoroscopic examination region is defined between the x-ray source and detector substantially along the centerline 51. By offsetting the x-ray source and detector offset from the C-arm, interference caused by the C-arm during interventional procedures is minimized.

The centerline 51 of the imaging system intersects with the orbit axis G of the C-arm. As a result, both the geometric center of the C-arm 30 and the imaging system centerline 51 are positioned at iso-center during a fluoroscopic imaging procedure. The imaging system centerline 51 rotates around, but does not shift laterally relative to, iso-center when the C-arm is orbited.

In contrast, with known C-arm systems, the centerline of the imaging system is laterally offset from the orbit axis of the C-arm. During an imaging procedure, the centerline of the imaging system is positioned at iso-center and the orbit axis of the known C-arm is laterally offset from iso-center. When the known C-arm is rotated about its orbit axis, the imaging system centerline shifts off iso-center. Thus, in order to maintain the imaging system centerline at iso-center when a known C-arm system is orbited, the whole C-arm must be laterally repositioned in addition to being orbited.

Figure 4:
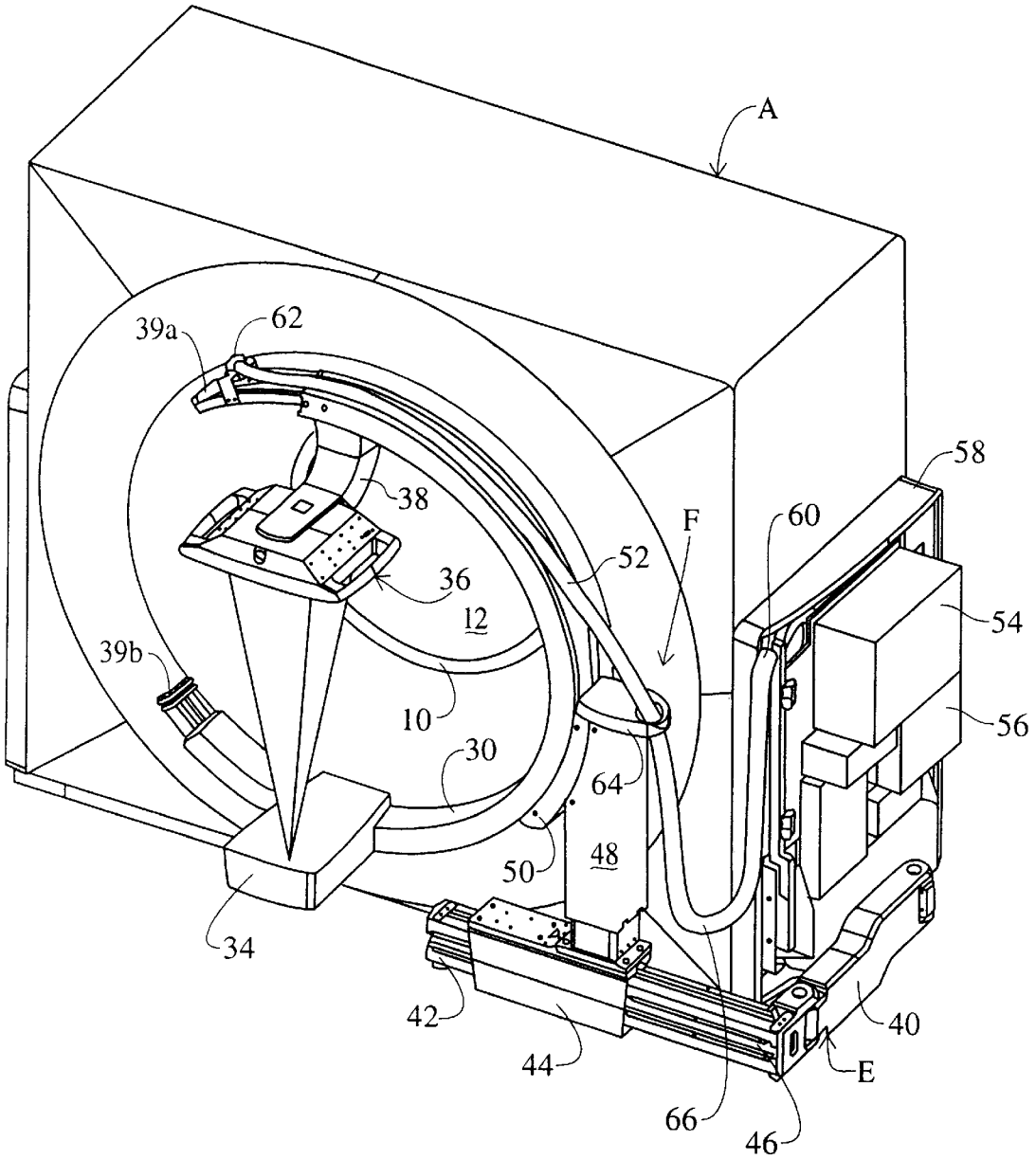
FIG. 4 is a perspective of the CT scanner of FIG. 1 showing a C-arm take-up/tension control system.
Figure 5:
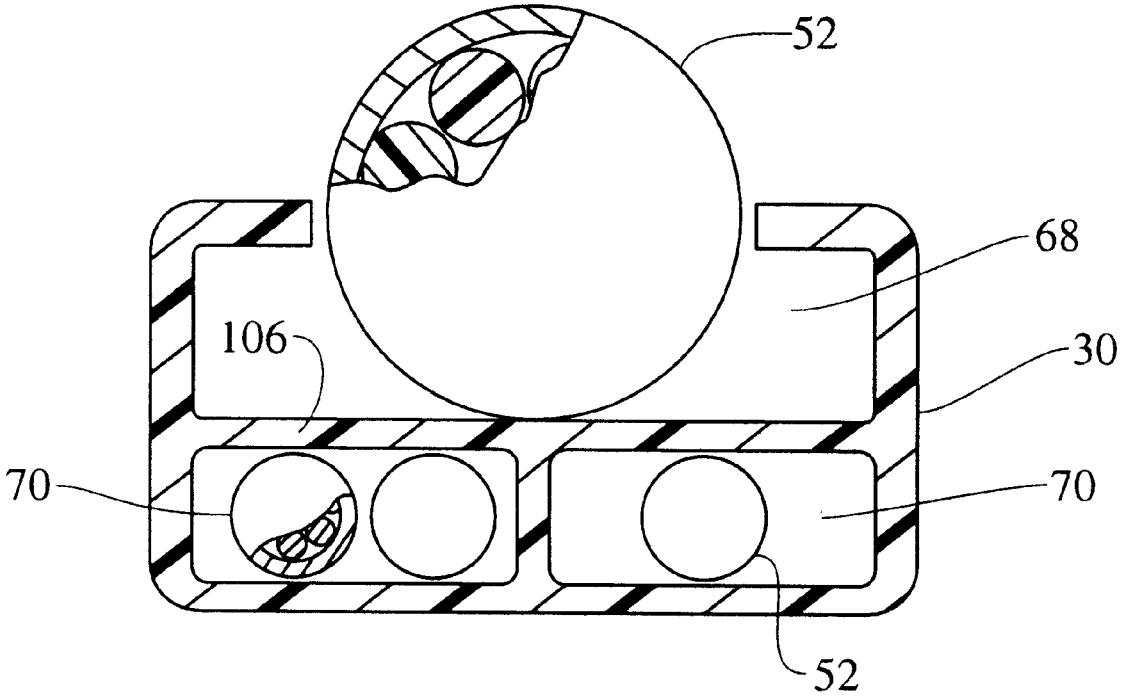
FIG. 5 is a cross section view of the C-arm taken along the line 5—5 of FIG. 3.

Referring now to FIGS. 4 and 5, a takeup/tension control system F for the C-arm 30 is shown. It should be appreciated that the C-arm is shown with one or more protective covers removed. One or more data/power cables 52 connect the x-ray source 32 and detector 36 to a fluoro-image reconstruction computer 54 and power supply 56 housed in a cabinet 58 which is mounted to the side of the gantry. A first hose anchor 60 secures an intermediate portion of the cable 52 to the cabinet 58. A second hose anchor 62 secures another intermediate portion of the cable to the upper end of the C-arm. A cable guide 64 is positioned on or above the second upright support arm 48 proximate the bearing assembly 50. The cable guide includes an aperture through which the cable 52 slidably passes. The portion of the cable 52 extending between the cable guide 64 and the first anchor 60 forms a variable length service loop 66. A portion of the cable 52 extending between the cable guide 64 and the second anchor 62 rests at least partially within an open channel 68 defined within an exterior surface of the C-arm. When the C-arm is rotated in a clockwise direction from the upright position shown in FIG. 4, a portion of the cable 52 resting within the channel 68 passes through the cable guide 64 and is taken up by the service loop 66. Likewise, when the C-arm is rotated in a counter-clockwise direction, a portion of the cable 52 defining the service loop 66 passes through the cable guide 64 and is guided into the channel 68.

A portion of the cable 52 extending past the second anchor 62 wraps around the upper counterweight 39*a* and passes through one or more closed channels 70 forming an inner portion of the C-arm 30. A portion of the cable 52 within the C-arm channels 70 pass through the support arms 34, 38 to connect to the x-ray source 32 and detector 36, respectively.

Figure 6:
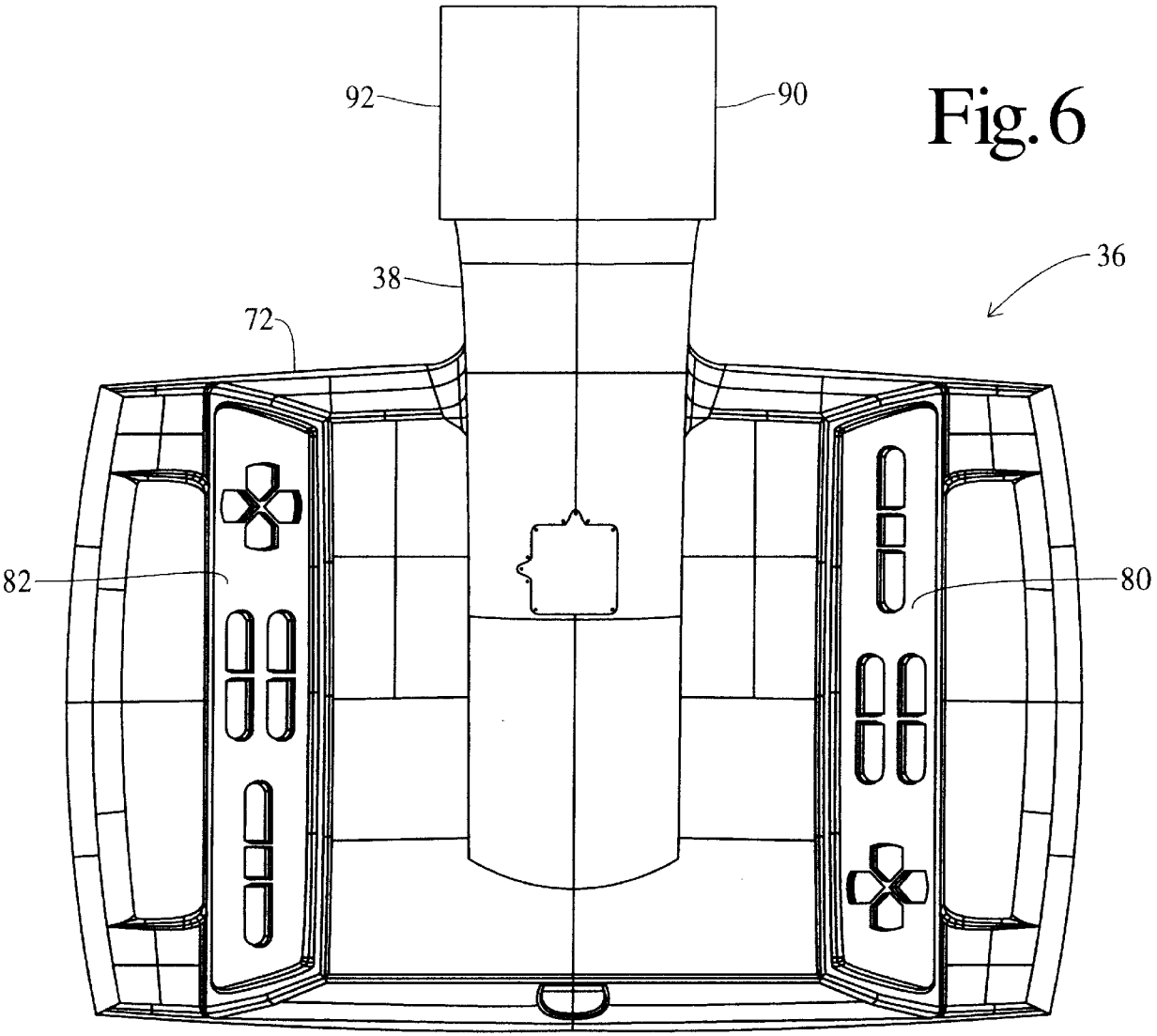
FIG. 6 is a top plan view of a flat panel image receptor housing mounted to the C-arm.
Figure 7:
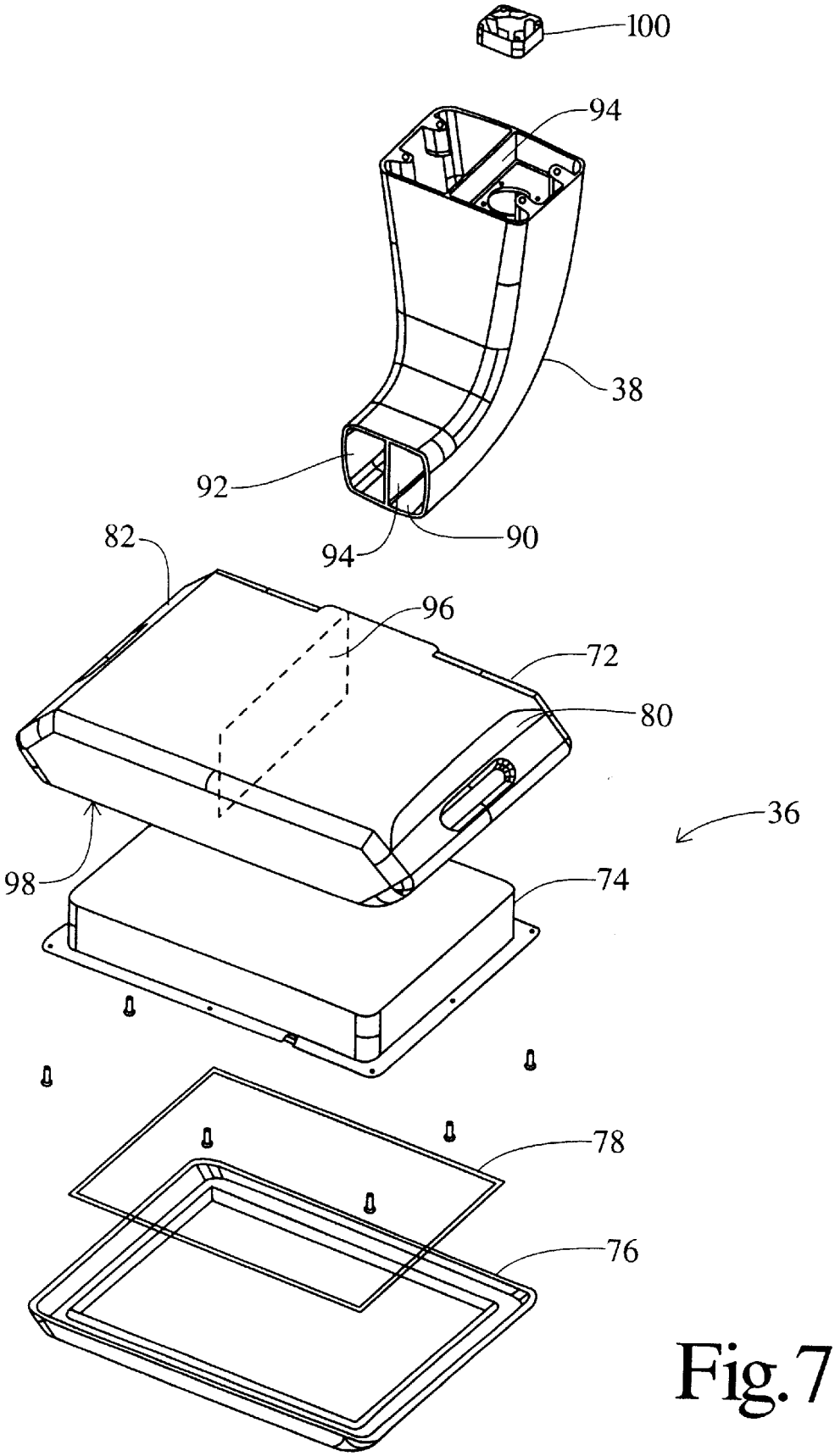
FIG. 7 is an exploded view of the flat panel detector housing of FIG. 6.

Referring now to FIGS. 6 and 7, the image detector 36 includes a housing 72 which supports a flat panel image receptor or array 74 of individual image receptors. A planar bezel 76 and gasket 78 seal the flat panel image receptor 74 into the housing so that the image receptor 74 can be cooled as described further below.

A "flat panel image receptor" as used herein includes a planar substrate such as glass laminated with an array of sensors such as amorphous silicon crystals that convert x-ray energy to electrical signals. That is, the sensors emit an electronic potential when struck by photons of x-ray energy. The intensity of the potential is related to the intensity of the x-ray beam. The electrical signals can be read out from a row/column matrix and then converted to digital data.

In the embodiment being described, an amorphous silicon flat panel image receptor includes a Cesium Iodide scintillating layer on an amorphous silicon glass substrate. The scintillating layer converts x-ray energy into light. An array of photodiodes on the glass substrate convert the light into electrical signals. The electrical signals are readout of a row/column matrix that is accessed using thin film transistor switches on the amorphous silicon substrate. The analog data is then converted to a digital format.

The amorphous silicon flat panel image receptor is compact in size and weight and replaces the conventional image intensifier tube, thus reducing the size of the detector 36. The mechanical support (i.e. support arm 38) for the detector 36 is also reduced in size and weight. Further, the flat panel image receptor 74 provides a rectangular image, eliminates the distortion of an image common to image intensifier tubes, and provides constant image quality across the flat panel of the image receptor, thus minimizing the amount of panning typically required with convention image intensifier tubes.

It should be appreciated that the flat panel image receptor can be of any dimension such as 20 cm×25 cm, and the system can be easily upgraded to incorporate larger flat panel image receptors. It is contemplated that a fluoro-assist device having a conventional image intensifier or alternate technology can be mechanically coupled to an imaging system in the same or similar manner as described above.

The housing 72 includes two handles integrally formed therein. A first control panel 80 is mounted at one end of the housing 72 adjacent one handle, and a second control panel 82 is mounted on the opposite end of the housing adjacent the other handle. Depending upon the particular orientation of the C-arm, either control panel 80, 82 can be used to adjust the position (i.e. rotate) the C-arm, depending upon which control panel is most accessible to the operator.

When the C-arm 30, and thus the x-ray source 32 and detector 36, is rotated to a lateral position on either side of the patient table, a physician performing an interventional procedure may position himself/herself behind the offset detector housing 72 to prevent direct exposure to the x-ray beam generated by the source 32, and to reduce exposure due to scattered radiation. The flat panel image receptor 74 may incorporate a lead shielding layer or other radiation absorbing material therein to minimize radiation exposure to the medical personnel. Alternatively, a lead shield may be incorporated into the housing 72.

As described above, the flat panel image receptor 74 within the housing 72 is coupled to the fluoro-image processing computer 54 housed in the cabinet 58 mounted to the side of the gantry. The fluoro-image processing computer 54 processes the acquired image from the detector 36 and permits an operator to adjust window and level functions of the displayed image. The fluoro-image generated by the fluoro-image reconstruction computer is displayed on an adjustable monitor 84 (FIGS. 1 and 2) connected to the gantry via a lateral support arm 86. Alternatively, the monitor 84 can be suspended from the ceiling, or located on a cart. The monitor 84 can be either a flat panel monitor or a standard CRT monitor. In addition, the fluoro-image output could go directly to a filming device. The fluoro-image output could also go to the diagnostic system and be displayed with the volumetric images on the display 20.

The fluoro-assist device D may be activated and deactivated with a foot pedal 88 (FIG. 1) in a conventional manner. When activated, the fluoro exposure can be either continuous or pulsed. In the pulsed mode, radiographic procedures such as CINE, Spot Film and DSA can be performed. The x-ray source 32 can be gated on and off in the pulsed mode using a conventional grid control circuitry or a pulse fluoro high-voltage power supply.

Figure 8:
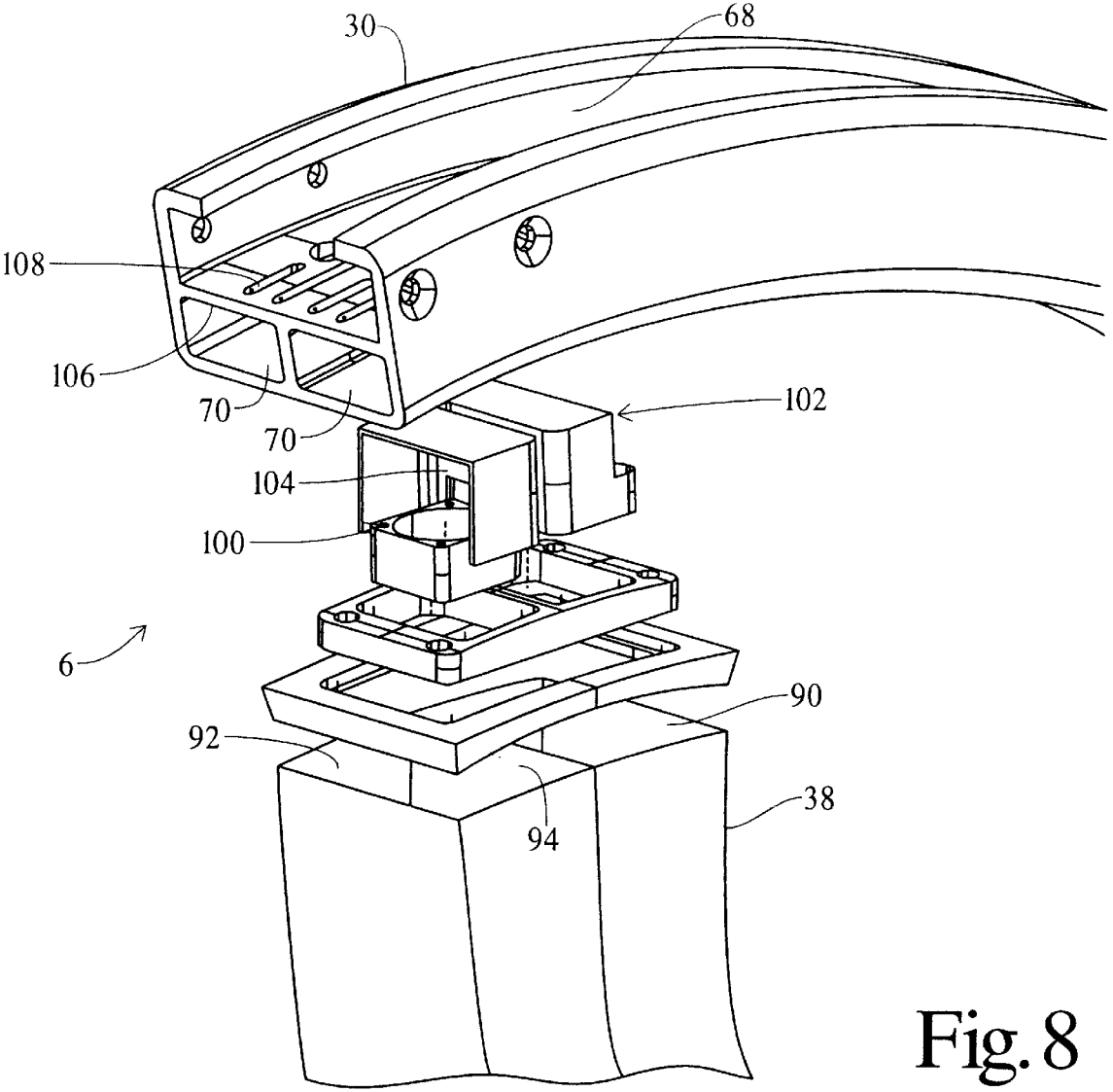
FIG. 8 is an exploded perspective view of an air exchange pathway through the C-arm and the support arm for the detector housing.

With continuing reference to FIG. 7, and further reference to FIG. 8, a cooling system G for the detector housing 72 is shown. The cooling system facilitates the removal of heat from within the housing 72 that is generated by electronic circuitry associated with flat panel image receptor 74. The cooling system includes a first air passage 90 and a second air passage 92 which extend through the support arm 38. A common wall 94 separates or isolates the air passages 90, 92 in the support arm 38. A baffle 96 extends contiguous from the common wall within an interior cavity 98 defined between an inner surface of the housing 72 and an upper surface of the flat panel image receptor 74.

A fan 100 is mounted within either one or both of the passages 90, 92. As shown in FIG. 7, the fan can be mounted within the first passage 90, which first passage can define either an exhaust passage or an inlet passage. Likewise, as shown in FIG. 8, the fan 100 can be mounted within the second passage 92, which second passage can define either an inlet passage or an outlet passage.

An air deflector 102 is mounted over the upper ends of the air passages 90, 92 and extends through an aperture in a bottom surface of the C-arm to permit the first and second air passages 90, 92 to communicate with the passages 70. The air deflector includes a transverse dividing wall 104 which extends contiguously from the common wall 94 within the passages 70 to separate inlet air flow from outlet air flow and thus prevent heated exhaust air from being recirculated through the housing 72.

A common wall 106 of the C-arm 30 separates the open channel 68 from the closed passages 70. A plurality of apertures or vents 108 extend through the common wall 106 to permit the closed passages to communicate with the open channel. The vents 108 can extend continuously along the C-arm or can be spaced at predetermined intervals thereal-ong.

When the fan 100 is positioned in the inlet passage of the support arm, the fan 1) draws ambient cooling air from around the open channel 68, through the vents 108 and passages 70, and into the inlet passage of the support arm, and 2) forces the cooling air into cavity 98 over the electronic components associated with the flat panel image receptor 74. As a result of the heat exchange occurring within the cavity 98, heated air is forced from within the cavity 98, through the exhaust passage, into the passages 70, and exhausted through the vents 108.

Alternatively, when the fan is positioned in the exhaust passage of the support arm, the fan 100 1) draws heated air from the cavity 98 through the exhaust passage, and 2) forces the heated air into the passages 70 and out through the vents 108. As a result, ambient cooling air is drawn in from around the open channel 68 through the vents 108 and passages 70, and into the inlet passage and cavity 98.

Thus, ambient air is drawn into the housing 72 from a location remote from an operating area surrounding the detector housing, and heated air from within housing is exhausted at a location remote from the operating area surrounding the detector housing. The remote intake and exhausting of air facilitates maintaining a sterile environment in the work area surrounding the detector housing.

Figure 9:
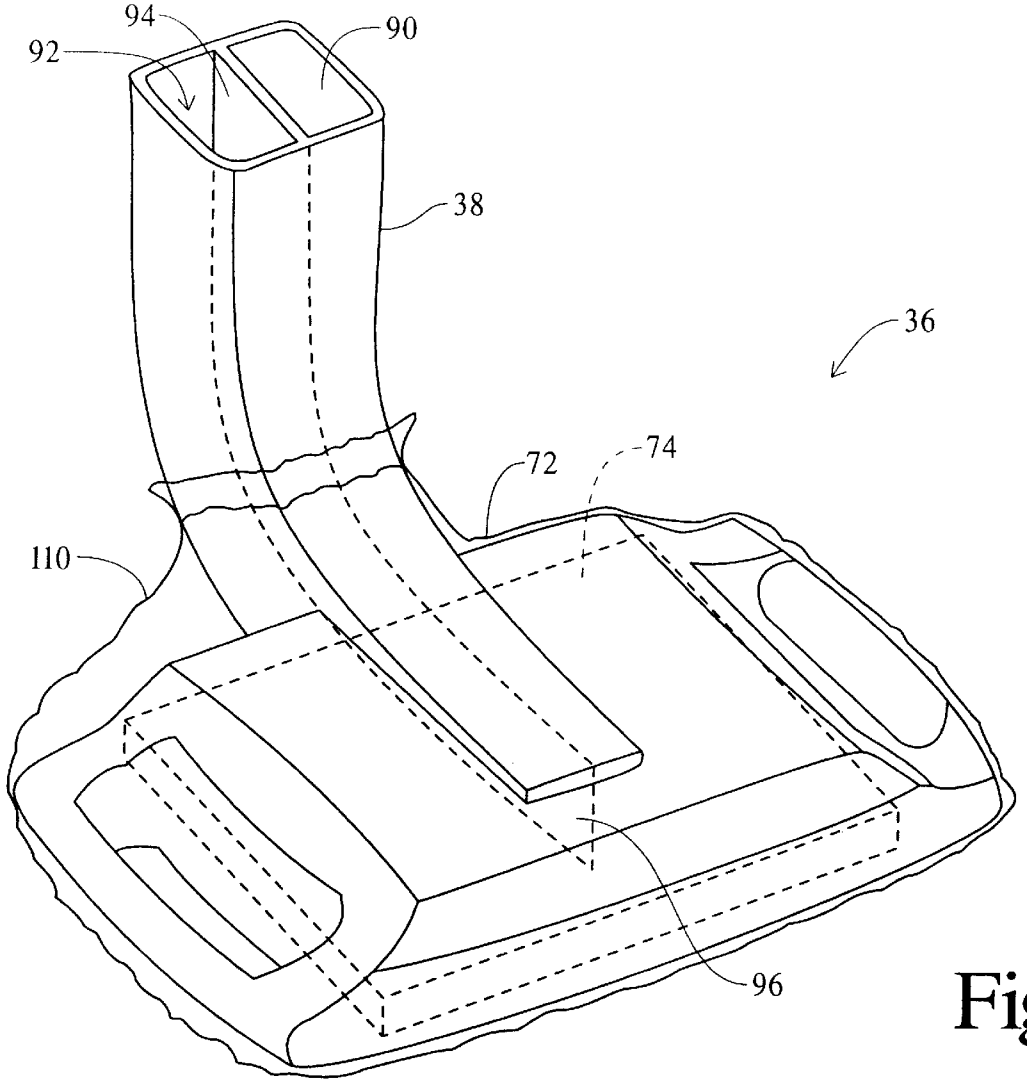
FIG. 9 is a perspective view of the air flow pathway through the support arm and the detector housing.

As shown in FIG. 9, the positive flow of ambient air that is drawn into the inlet passage 92 is delivered into the cavity 98 and across the top of the flat panel image receptor 74 while a sealed sterile covering or bag 110 remains in place over the housing 52. Medical personnel may still grasp the handles of the housing 52 and operate the control panels 80, 82 with the sterile covering 110 in place over the housing.

When air exchange occurs within the cavity 98, the baffle 96 directs the air flow across the upper surface of the flat panel image receptor prior to being drawn or forced out the exhaust passage 90. It should be appreciated that without the baffle 96, a substantial portion of the air drawn into the inlet passage would pass directly into the exhaust passage without first flowing over the flat panel image receptor 74.

It should be appreciated that the C-arm 30 of the above-described invention can be a stand-alone device which is mounted near the gantry and which provides the same functions described above. In particular, the C-arm can be suspended from a ceiling via an overhead track system. Alternatively, the offset C-arm can be mounted to a mobile cart.

In addition, it should be appreciated that the above-described invention could be used in conjunction with other types of imaging devices, such as radiographic imaging devices, which incorporate a flat panel detector housing. Further, the cooling system may also be useful in cooling the housing for the x-ray source 32.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An imaging device comprising:

a support member;

an x-ray source mounted to the support member;

an x-ray detector mounted to the support member, the x-ray detector including a sealed housing defining a cavity, and including a flat panel image receptor retained within the cavity; and a cooling system for exchanging heated air in the housing with ambient air located remote from the housing.

2. The imaging device of claim 1, further including a cantilevered arm for securing the housing to the support member, the cantilevered arm including an inlet passage and an exhaust passage each communicating with the cavity at a respective first end thereof.

3. The imaging device of claim 2, further including at least one fan positioned in at least one of the exhaust passage and the inlet passage.

4. The imaging device of claim 2, further including a baffle within the cavity to direct air flow therein.

5. The imaging device of claim 2, wherein:

the support member includes an open channel, a closed channel, a common wall separating the open channel from the closed channel, and at least one vent through the common wall; and the inlet passage and exhaust passage each communicate with the closed passage at a respective second end thereof.

6. The imaging device of claim 5, further including an air deflector extending over the inlet passage and the outlet passage at the second ends thereof to reduce a flow of exhaust air drawn into the inlet passage.

7. The imaging device of claim 2, wherein:

the support member includes a C-arm; and the housing is offset from a plane of the C-arm by the cantilevered arm.

8. The imaging device of claim 1, wherein the flat panel image receptor includes a scintillating layer which coverts x-rays into light, and an amorphous silicon glass substrate supporting a plurality of photodiodes which convert the light generated by the scintillating layer into electrical signals.

9. The imaging device of claim 1, further including a mounting structure for securing the support member to a diagnostic imaging device, the mounting structure being movable to position the support member in a stored position adjacent the imaging device and to position the support member in an operating position proximate an examination region of the imaging device.

10. The imaging device of claim 1, further including a bag sealed around the housing to facilitate maintaining the sterility of the environment proximate the housing.

11. An imaging device including a frame having a bore therethrough defining an examination region, an image reconstruction processor for reconstructing volumetric image representations of an object positioned within the examination region, and a fluoroscopy device for generating and displaying fluoroscopic projection image representations of the object, the fluoroscopy device including:

a support member;

an x-ray source mounted to the support member;

an x-ray detector mounted to the support member, the x-ray detector including a sealed housing defining a cavity, and including a flat panel image receptor retained within the cavity; and a cooling system for exchanging heated air in the housing with ambient air located remote from the housing.

12. The imaging device of claim 11, further including a baffle within the cavity to direct air flow therein.

13. The imaging device of claim 11, further including a cantilevered arm for securing the housing to the support member, the cantilevered arm including an inlet passage and an exhaust passage each communicating with the cavity at respective first ends thereof.

14. The imaging device of claim 13, further including at least one of the inlet passage and outlet passage supporting a fan positioned therein.

15. The imaging device of claim 13, wherein:

the support member includes an open channel, a closed channel, a common wall separating the open channel from the closed channel, and at least one vent through the common wall; and the inlet passage and exhaust passage each communicating with the closed passage at respective second ends thereof.

16. The imaging device of claim 13, further including an air deflector extending over the inlet passage and the outlet passage at respective second ends thereof to reduce a flow of exhaust air drawn into the inlet passage.

17. The imaging device of claim 11, further including a mounting structure for securing the support member to the frame, the mounting structure being movable to position the support member between a stored position and an operating position.

18. The imaging device of claim 11, wherein the flat panel image receptor includes a scintillating layer which coverts x-rays into light, and an amorphous silicon glass substrate supporting a plurality of photodiodes which convert the light generated by the scintillating layer into electrical signals.

19. A method of generating fluoroscopic image representations of an object using a fluoroscopy device having a support member, an x-ray source mounted to the support member, and an x-ray detector mounted to the support member, the x-ray detector including a sealed housing defining a cavity, and including a flat panel image receptor retained within the cavity, the method comprising:

activating the x-ray source and x-ray detector; and exchanging heated air in the sealed housing with ambient air at a location remote from the housing.

20. The method of claim 19, wherein:

the housing is secured to the support member by a cantilevered arm; and the exchanging step includes:

activating a fan to draw ambient air into the sealed housing through an inlet passage defined within the cantilevered arm and to force heated air from the sealed housing through an exhaust passage defined within the cantilevered arm.

21. The method of claim 20, wherein:

the support member includes an open channel, a closed channel, a common wall separating the open channel from the closed channel, and at least one vent through the common wall, the inlet passage and exhaust passage each communicating with the closed passage at respective ends thereof; and the exchanging step further includes drawing air from the open channel through the vent and closed passage into the inlet passage, and exhausting heated air from the exhaust passage through the closed channel and vent and to the open channel.

22. The method of claim 21, wherein the exchanging step includes:

directing air flow through the closed channel with an air deflector to reduce a flow of exhausted air drawn into the inlet passage.

23. The method of claim 19, wherein the exchanging step includes:

directing air flow through the sealed housing with a baffle in the housing.

24. The method of claim 19, wherein the flat panel image receptor includes a scintillating layer which coverts x-rays into light, and an amorphous silicon glass substrate supporting a plurality of photodiodes which convert the light generated by the scintillating layer into electrical signals.

* * * * *